US006209735B1

(12) United States Patent
Gladstone et al.

(10) Patent No.: US 6,209,735 B1
(45) Date of Patent: Apr. 3, 2001

(54) INTERLOCKING TUBE

(75) Inventors: Brian A. Gladstone, Westminster, CO (US); Bobby L. Magness, Phoenix, AZ (US)

(73) Assignee: Colorado Clubhouse Company, Inc., Westminster, CO (US)

( * ) Notice: Subject to any disclaimer, the term of this patent is extended or adjusted under 35 U.S.C. 154(b) by 0 days.

(21) Appl. No.: 09/449,167

(22) Filed: Nov. 24, 1999

(51) Int. Cl.[7] ..... A47F 5/00

(52) U.S. Cl. ..... 211/88.01; 211/71.01; 211/74; 211/194

(58) Field of Search ..... 211/74, 88.01, 211/194, 71.01, 85.18; 273/157 R; 312/107, 108, 111; 446/127; 52/586.2, 590.1, 590.2, 591.1, 591.2, 591.5; D7/701

(56) References Cited

U.S. PATENT DOCUMENTS 3,552,817 * 1/1971 Marcolongo ..... 312/107
3,981,506 * 9/1976 Daniel et al. ..... 273/157 R
4,003,172 * 1/1977 Pawl ..... 52/279
4,270,662 * 6/1981 Gonzalez ..... 211/74
4,423,913 * 1/1984 Lee ..... 211/194 X
5,046,789 * 9/1991 Lee ..... 312/108
5,267,863 * 12/1993 Simmons, Jr. ..... 434/96
5,775,046 * 7/1998 Fanger et al. ..... 312/107 X
5,947,305 * 9/1999 Lin ..... 211/74

* cited by examiner

*Primary Examiner*—Robert W. Gibson, Jr.

(57) ABSTRACT

An interlocking tube and tube arrangement are provided. The tube includes an interior surface being adapted to allow placement of the object. The tube includes an exterior surface having a number of rails and a number of channels formed therein. Both the rails and channels have side surfaces that are back-cut. Portions of the rails and channels are cross-sectionally sized and shaped similarly to each other to permit a first tube to matingly engage a second, similar tube. The rails and channels extend between tube ends and are formed alternatingly about the tube exterior surface in an orientation parallel to the tube longitudinal axis. To engage the two tubes together, the rails of the first tube are slid into the correspondingly-sized channels of the second tube, their mutually back-cut side surfaces maintaining their engaged relationship. In one embodiment, the tubes are interlocked at angles of 90 degrees therebetween. In another embodiment, the tubes are interlocked at angles of 60 degrees therebetween.

18 Claims, 5 Drawing Sheets

INTERLOCKING TUBE

FIELD OF THE INVENTION

The present invention relates to storage and display devices, and more particularly, to interlocking components capable of being mechanically connected to form a storage or display unit.

BACKGROUND OF THE INVENTION

Currently, there are numerous small objects that people own and collect that are difficult to display and store because of the object having an odd shape or size. Wall-mounted display racks can be used, but are not optimal since they cannot easily conform to the precise size of a collection. For example, if the collection has only a few objects, then the display rack will appear empty due to the unfilled areas. If the collection has more objects than a single rack can hold, then a second display rack will have to be used. In addition, rarely are these wall mounted structures of sufficient depth to allow larger objects to be displayed easily. Thus, a need exists for a display device that can accommodate any number of objects and can accommodate objects of awkward size or shape. The present invention is directed to fulfilling these needs and others as described below.

SUMMARY OF THE INVENTION

In accordance with the present invention, both a unique interlocking tube and an arrangement of the tubes are provided. By coupling one tube to another, an arrangement of interlocking tubes can be made to hold any number of awkwardly shaped objects. Each tube has a number of alternating rails and channels that are parallel and extend longitudinally along the exterior surface of the tube. Both the rails and channels have side surfaces that are back-cut. All of the tubes have similar rails and channels that are cross-sectionally sized and shaped. This permits one tube to matingly engage with another similar tube. To engage two tubes together, the rails of one tube are slid into the correspondingly-sized channels of another tube. This allows the mutually back-cut side surfaces to maintain an interlocked relationship. In one embodiment, the tubes are interlocked at angles of 90 degrees therebetween. In another embodiment, the tubes are interlocked at angles of 60 degrees therebetween.

BRIEF DESCRIPTION OF THE DRAWINGS

The foregoing aspects of many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

The present invention is an interlocking tube 10 and arrangement of multiple tubes to form an object holder 12 to store or display objects O in a collection. Each interlocking tube is substantially identical and can be mechanically connected to similar tubes to form the object holder.

Figure 1:
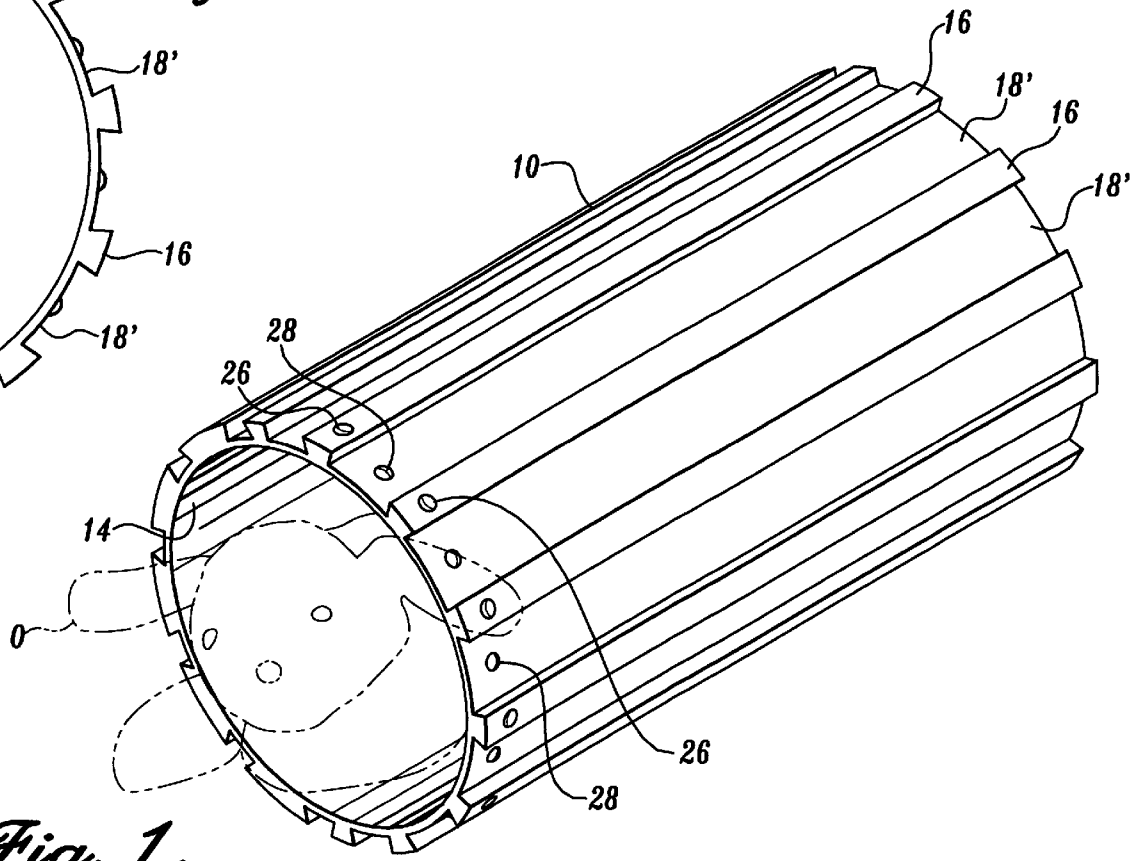
FIG. 1 is a perspective view of an interlocking tube formed in accordance with the present invention.

Referring to FIG. 1, an interlocking tube 10 formed in accordance with the present invention includes an interior surface 14 and an exterior surface. The interior surface 14 may be smooth or rough and may be sizes to accommodate objects O of various sizes. The exterior surface includes a number of rails 16 and channels 18. In the embodiment shown in FIGS. 1–4, the rails and channels are alternatingly formed around the tube's entire exterior surface. The rails and channel are oriented so that their longitudinal dimension is parallel to one another. In addition, the rails and channels are preferably oriented on the tube's exterior surface so that they are parallel to the longitudinal axis of the tube as well.

In preferred embodiments, a tube 10 is formed by creating a relatively long extruded piece of tubing with the necessary rails and channels, and then cutting the tube into small portions depending on the desired length. The tube may be formed of various known materials, such as known thermoplastic materials. Any type of conventional indicia or coloring may be used to decorate that tubes.

Figure 2:
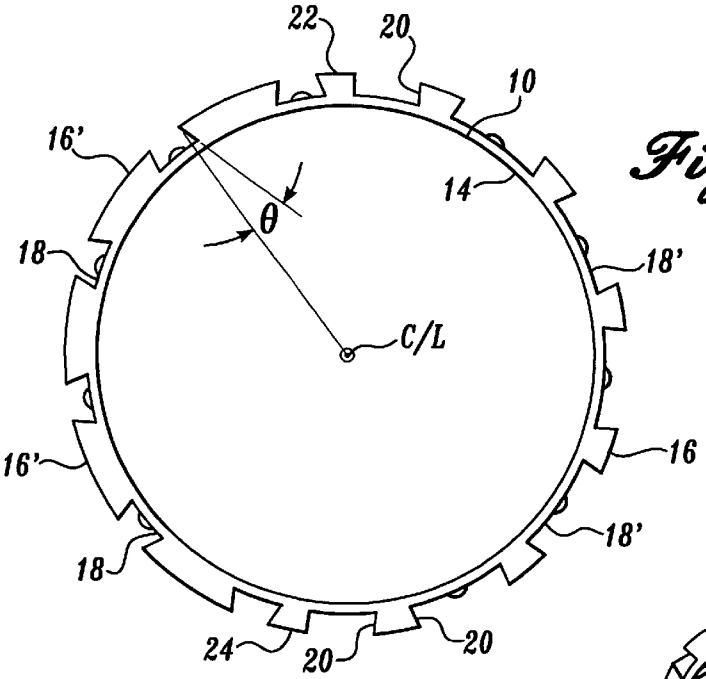
FIG. 2 is an end view of the tube of FIG. 1.

Referring to FIG. 2, the rails 16 and channels 18 both include back-cut side surfaces 20, shown as formed at angle $\alpha$. Because the embodiment of interlocking tube shown in FIGS. 1–5 uses immediately-adjacent alternating rails and channels, the back-cut side surface of each rail simultaneously forms the back-cut side surface of the adjacent channel. Other arrangements are possible. The important feature is the ability of the rail to be mechanically held within the channel using these back-cut side surfaces. The angle $\alpha$ is preferably about 27.5° degrees. FIG. 6 illustrates further sizes and angles that may be used.

Still referring to the embodiment shown in FIG. 2, tube 10 includes an arrangement in which approximately half of the rails (labeled 16) are a first width and the other half (labeled 16') are a second, larger width. Likewise, half of the channels (labeled 18) are a first width and the other half (labeled 18') are a second, larger width. The smaller channels 18 are interspaced between the larger rails 16', and the larger channels 18' are interspaced between the smaller rails 16. There are two "end" rails 22, 24 that do not include a back-cut side surface on one of their sides. These two end rails 22, 24 are provided to engage the arrangement of FIG. 4. In preferred embodiments, the tube's length is greater in size than the tube's outer diameter.

Figure 3:
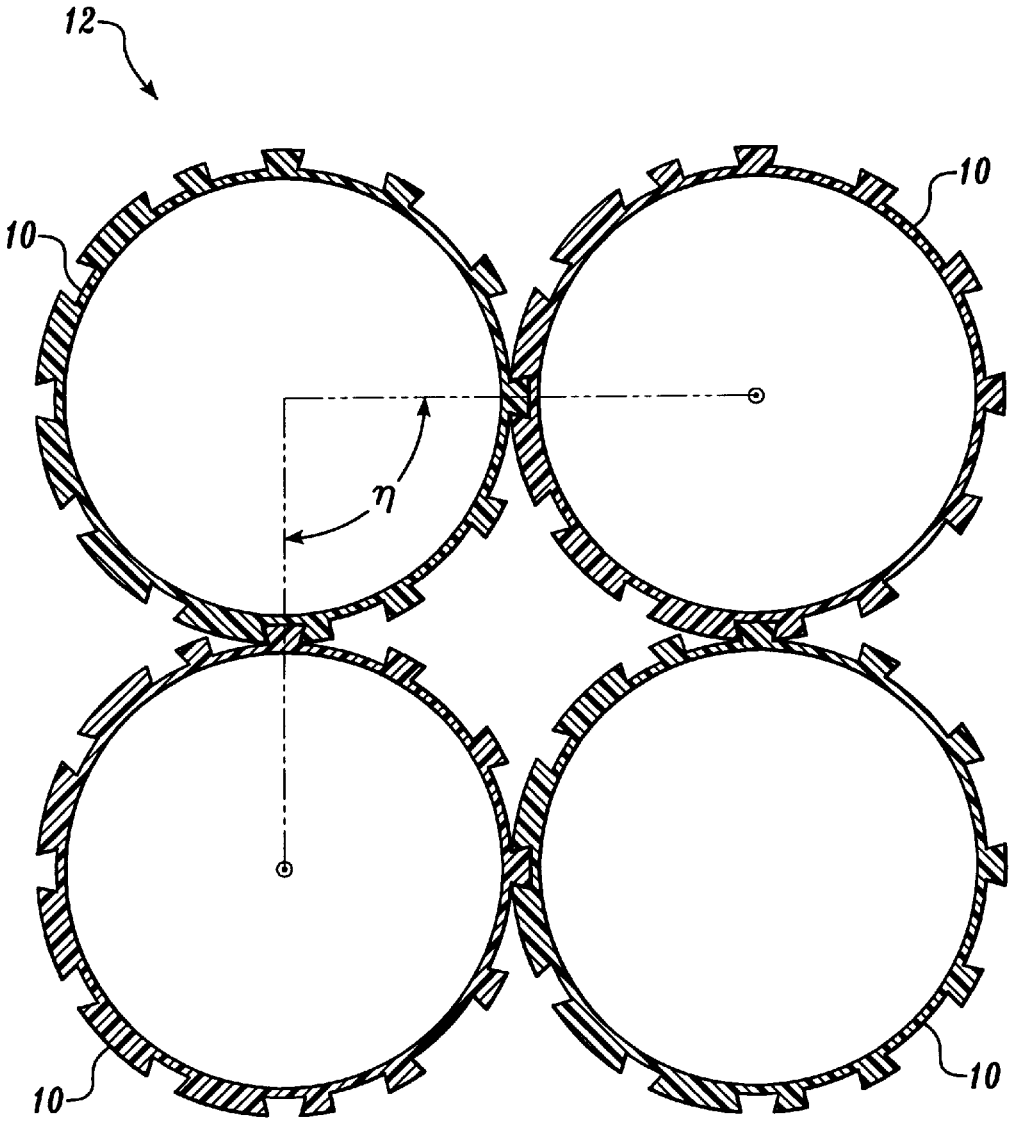
FIG. 3 is an end view of one arrangement of tubes joined together to form an object holder formed in accordance with the present invention.

To use the interlocking tubes, a first tube is held while a second tube is slid into an interlocking relation therewith. The rails of the second sliding into correspondingly-sized channels of the first tube. As will be appreciated, by using back-cut side surfaces, the rails of one tube can be held securely within a channel of another tube. Additional tubes may be added as necessary. By providing various sizes and placement of the rails and channels about the exterior surface, various formations may be constructed. For example, using the tube shown in FIG. 1, interlocking arrangements may be formed such as those shown in FIGS. 3, 4, and 5. The arrangement in FIG. 3 is one in which tubes are interlocked about a tube at angles of 90 degrees apart. The arrangements of FIGS. 4 and 5 are ones in which the tubes are interlocked about a tube at non-90 degree angles, such as the 60 degrees shown.

Figure 4:
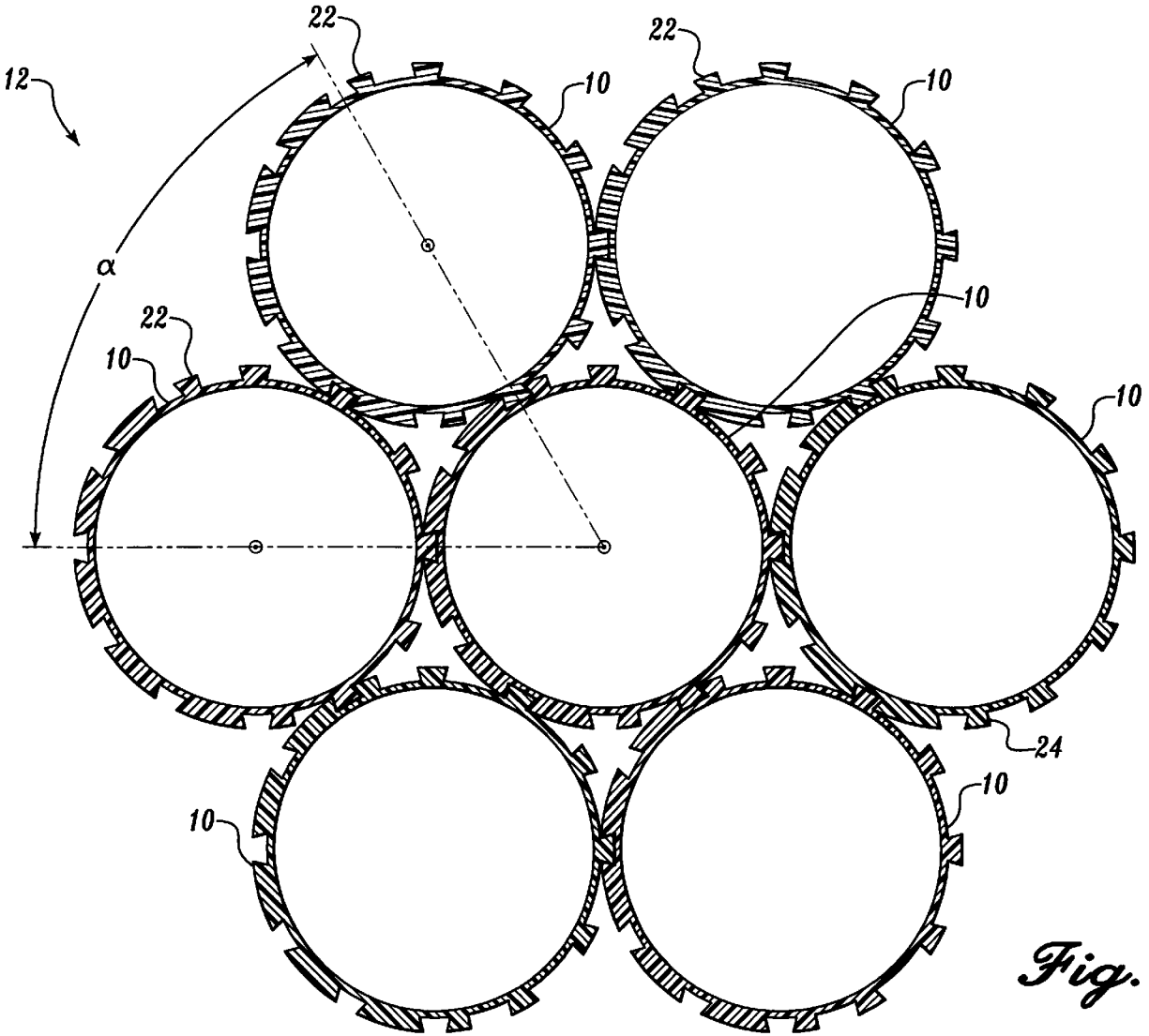
FIG. 4 is an end view of another arrangement of tubes joined together to form an object holder in accordance with the present invention.
Figure 5:
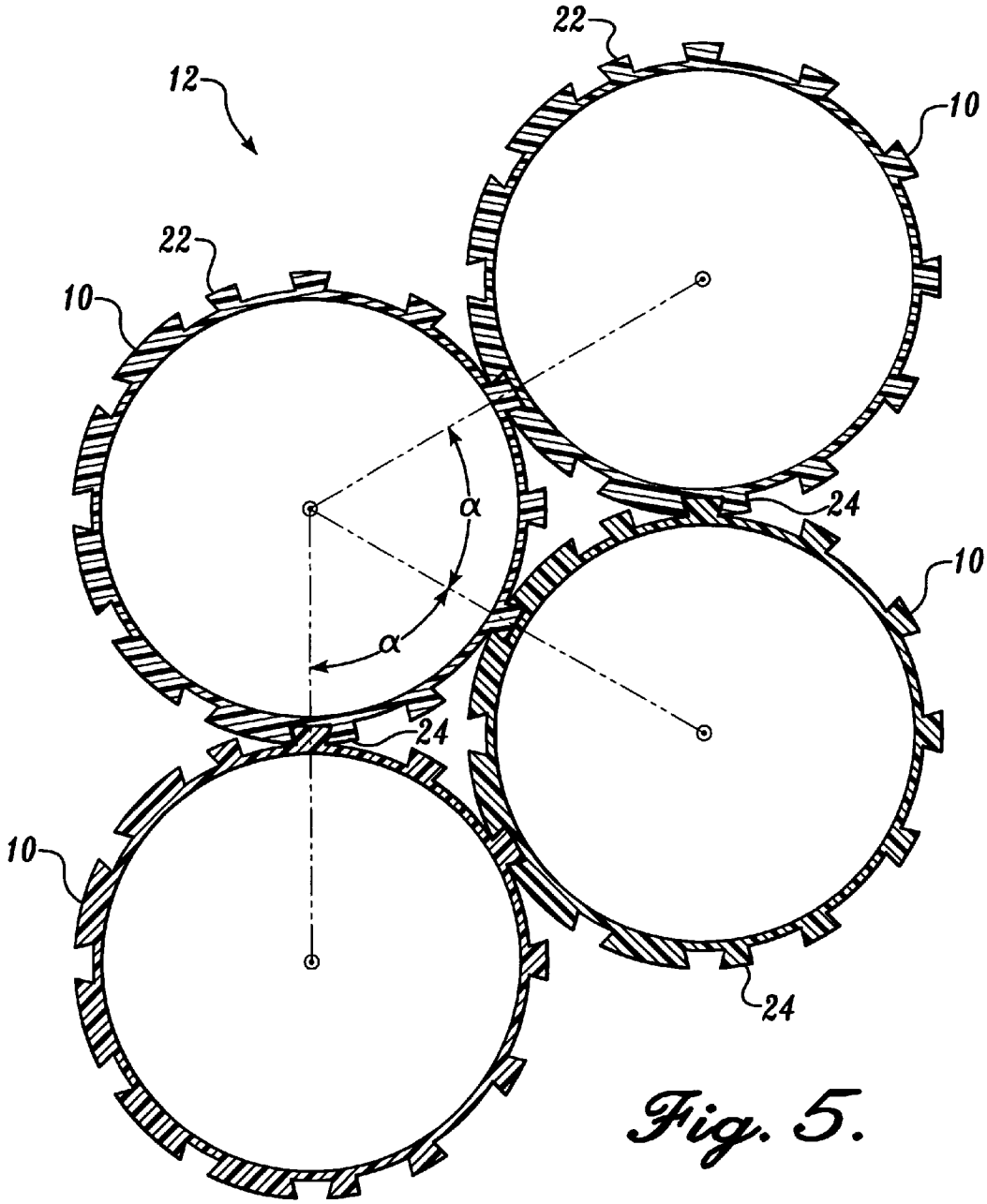
FIG. 5 is an end view of yet another arrangement of tubes joined together to form an object holder in accordance with the present invention.
Figure 6:
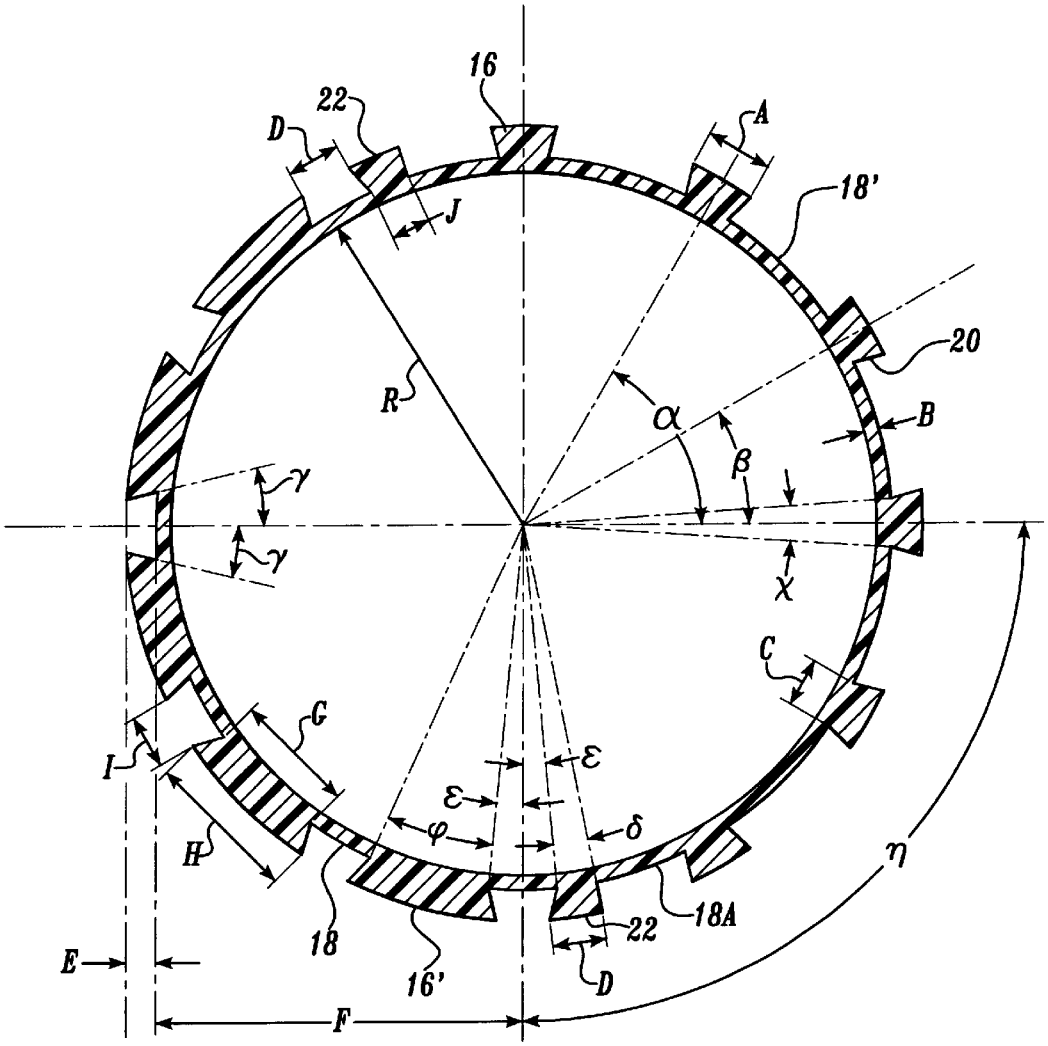
FIG. 6 illustrates size and angle amounts of the tube of FIG. 1.

It will be appreciated from viewing FIGS. 4 and 5 that in mating adjoining tubes, the user should be careful to place each tube in the same orientation. For example, in FIG. 4 the end rail 22 is used in mating adjacent tubes. In FIG. 5, the end rail 24 is used in mating adjacent tubes. Either way, all tubes of a single combination are positioned in the same manner.

The embodiment of FIG. 1 includes various dimples 26 formed in the channels 18 and various bumps 28 formed in the rails 16. The dimples 26 and bumps 28 are located and sized so as to engage each other during use to encourage adjoining tubes to maintain their interrelationship. It has been found that these dimples and bumps are not typically necessary, though, depending on the application.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A tube for holding an object, the tube comprising:

a cylindrical body with an interior surface and an exterior surface, the interior surface being adapted to allow placement of the object;

a number of rails and a number of channels formed in the exterior surface, approximately half of the rails and channels having a first width and half of the rails and channels having a second width, the second width being larger than the first width; both the rails and channels having side surfaces that are back-cut, portions of the rails and channels being cross-sectionally sized and shaped similarly to each other to permit the tube to matingly engage another tube; and a first end and a second end, the rails and channels extending between tube ends and being formed alternatingly about the tube exterior surface in an orientation parallel to the tube longitudinal axis; the smaller channels being interspaced between the larger rails and the larger channels being interspaced between the smaller rails;

whereby to engage the tube with another tube, the rails of the tube are slid into the correspondingly-sized channels of the other tube, their mutually back-cut side surfaces maintaining their engaged relationship.

2. The tube according to claim 1, wherein the rails and channels include side surfaces back-cut by an angle in the range of about 25 degrees to about 28 degrees.

3. The tube according to claim 1, wherein the tube is formed of a thermoplastic materials.

4. The tube according to claim 1, wherein the rails include dimples formed in their outward surface at the tube first end, and the channels include bumps formed in their outward surface at the tube first end; whereby when mated with another tube, the dimples and bumps engage to help secure the mating relationship of the tubes.

5. An object holder comprising a number of interlocking tubes, each tube including:

a cylindrical body with an interior surface, an exterior surface, and a longitudinal centerline; the interior surface being adapted to allow placement of the object;

a number of rails and a number of channels formed in the exterior surface, approximately half of the rails and channels having a first width and half of the rails and channels having a second width, the second width being larger than the first width; both the rails and channels having side surfaces that are back-cut, portions of the rails and channels being cross-sectionally sized and shaped similarly to each other to permit a first tube to matingly engage a second tube; and a first end and a second end, the rails and channels extending between tube ends and being formed alternatingly about the tube exterior surface in an orientation parallel to the tube longitudinal axis; the smaller channels being interspaced between the larger rails and the larger channels being interspaced between the smaller rails;

wherein to engage the first tube with the second tube, the rails of the first tube are slid into the correspondingly-sized channels of the other tube, their mutually back-cut side surfaces maintaining their engaged relationship.

6. The object holder according to claim 5, wherein the tubes are interlocked at angles of 90 degrees between their longitudinal centerlines.

7. The object holder according to claim 5, wherein the tubes are interlocked at angles of 60 degrees between their longitudinal centerlines.

8. The object holder according to claim 5, wherein the tube rails and channels include side surfaces back-cut by an angle in the range of about 25 degrees to about 28 degrees.

9. The object holder according to claim 5, wherein the tube is formed of a thermoplastic material.

10. The object holder according to claim 5, wherein the tube rails include dimples formed in their outward surface at the tube first end, and the channels include bumps formed in their outward surface at the tube first end; whereby when mated with another tube, the dimples and bumps engage to help secure the mating relationship of the tubes.

11. The tube according to claim 1, wherein the smaller channels and larger rails are located along one side of the cylinder and the larger channels and smaller rails are located along the opposite side of the cylinder.

12. The tube according to claim 1, wherein the smaller rails and channels are approximately 0.2188 inches wide and the larger rails and channels are approximately 0.6404 inches wide.

13. The tube according to claim 1, wherein the total tube radius is approximately 1.7188 inches.

14. The tube according to claim 1, wherein there are at least ten rails and ten channels, including at least five smaller rails and channels and at least five larger rails and channels.

15. The object holder according to claim 5, wherein the smaller channels are larger rails are located along one side of the cylinder and the larger channels and smaller rails are located along the opposite side of the cylinder.

16. The object holder according to claim 5, wherein the smaller rails and channels are approximately 0.2188 inches wide and the larger rails and channels are approximately 0.6404 inches wide.

17. The object holder according to claim 5, wherein the total tube radius is approximately 1.7188 inches.

18. The object holder according to claim 5, wherein there are at least ten rails and ten channels, including at least five smaller rails and channels and at least five larger rails and channels.

* * * * *

UNITED STATES PATENT AND TRADEMARK OFFICE

CERTIFICATE OF CORRECTION

PATENT NO. : 6,209,735 B1
DATED : April 3, 2001
INVENTOR(S) : B.A. Gladstone et al.

It is certified that error appears in the above-identified patent and that said Letters Patent is hereby corrected as shown below:

Column 3,
Line 51, "smaller channels are larger rails" should read -- smaller channels and larger rails --

Signed and Sealed this

Eighteenth Day of December, 2001

*Attest:*

*Attesting Officer*

JAMES E. ROGAN
*Director of the United States Patent and Trademark Office*